US005649705A

United States Patent [19]

String

[11] Patent Number: 5,649,705

[45] Date of Patent: Jul. 22, 1997

[54] MODIFIED METHOD OF PLAYING BLACKJACK

[76] Inventor: Elizabeth String, 7 Lawn Pl., Atlantic City, N.J. 08401

[21] Appl. No.: 753,396

[22] Filed: Nov. 26, 1996

Related U.S. Application Data

[63] Continuation-in-part of Ser. No. 596,681, Feb. 5, 1996.

[51] Int. Cl.[6] ..... A63F 1/00

[52] U.S. Cl. ..... 273/292; 273/274

[58] Field of Search ..... 273/292, 274, 273/309

[56] References Cited

U.S. PATENT DOCUMENTS 5,174,579 12/1992 Griffiths ..... 273/292

5,257,810 11/1993 Schorr et al. ..... 273/292

*Primary Examiner*—Benjamin H. Layno

*Attorney, Agent, or Firm*—Norman E. Lehrer

[57] ABSTRACT

A modified method of playing Blackjack on a table having a dealer location and at least one player location with a first betting area and a second betting area. The player to elects whether to bet on the player obtaining a winning hand by placing a wager on the second betting area, or whether to bet on the dealer obtaining a winning hand by placing a wager on the first betting area. The player places a wager on the second betting area if the player elects to bet on the player obtaining a winning hand. The player and dealer are each dealt two cards. If the player elects to bet on the player obtaining a winning hand, a round of Blackjack is played according to conventional rules. If the player elects to bet on the dealer obtaining a winning hand, the round of Blackjack is played in the following manner. Additional cards are dealt to the player until the player obtains a hand having a value of 17 or more. The player wins on the wager if the value of the player's hand is over 21. If the value of the player's hand is less than 21, additional cards are dealt to the dealer on top of the dealer card area until the dealer obtains a hand having a value of 17 or more. The dealer's hand is then compared to the player's hand and the player will be deemed the winner if the value of the dealer's hand is not over 21 but is higher than the value of the player's hand.

6 Claims, 1 Drawing Sheet

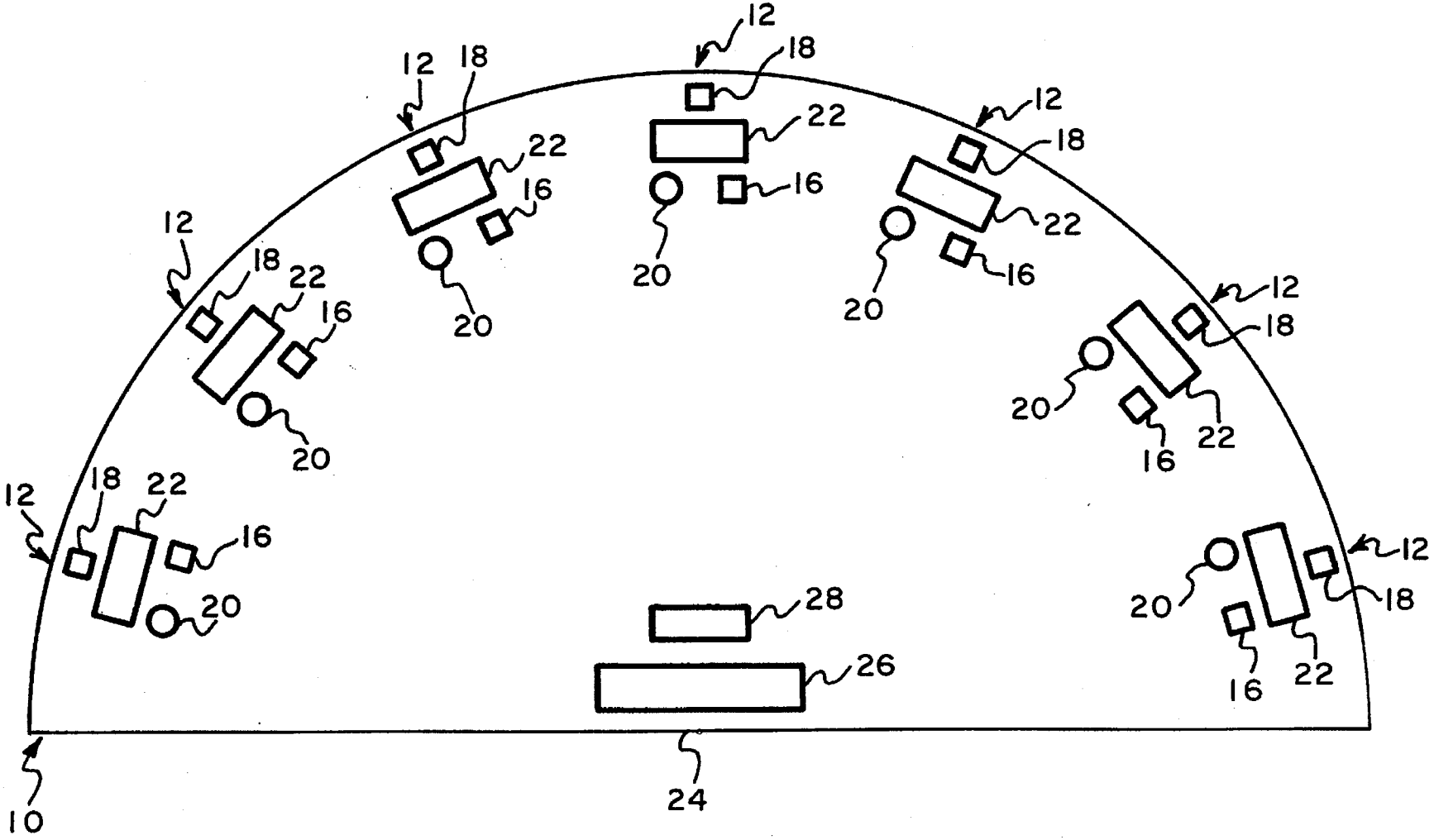
12
18
22
16
20
26
28
24
10

MODIFIED METHOD OF PLAYING BLACKJACK

CROSS-REFERENCE TO RELATED APPLICATION

This application is a continuation in part of prior application Ser. No. 08/596,681, filed Feb. 5, 1996.

BACKGROUND OF THE INVENTION

The present invention is directed toward a modified method of playing Blackjack and, more particularly, to such a method wherein a player is permitted to wager on his hand or the dealer's hand winning.

Blackjack, which is also known as Twenty-one, has been played for many years. It is often played in casinos where one or more players are pitted against a dealer. At least one deck of playing cards is used for playing Blackjack. A common method of playing Blackjack in a casino is as follows:

Each player makes an initial wager or ante before any cards are dealt. The dealer then deals two cards face up to each of the players and deals two cards, one of which is face up, to himself. Each of the numbered cards has a value equal to the card number, each of the face cards has a value of ten, and each of the aces has a value of one or eleven, whichever is most beneficial to the player.

Each player is then allowed to take as many "hits" (additional cards) as he or she desires until the player chooses to "stand" (stops with a hand which has a value of less than or equal to 21) or "busts" (has a hand that has a value of over 21). If a player busts, his wager is lost. Once each of the players has finished his turn, the dealer turns over the card he dealt face down to himself. If the dealer's hand has a value of 17 or over he is not allowed to receive any additional cards. If the dealer's hand is less than 17 he must take additional hits until he obtains a hand with a value of 17 or more. If the dealer goes over 21, each player who did not bust wins. If the dealer's hand is less than 21, then the value of the hand of each of the players is separately compared with the dealer's hand. The players who have a higher hand than the dealer win. If a player has a winning hand he is typically paid on a 1 to 1 ratio. If the player's hand is equal to the dealer, it is called a "push" and the player's initial wager is returned to him.

There are various other well known rules associated with Blackjack. For example, if the two cards the player is initially dealt has a value of 21 (called "blackjack"), the player receives 1.5 times his initial wager.

Further, if the card the dealer initially deals himself face up is an ace, each of the players is allowed to make an "insurance" wager. Specifically, each player can wager up to one-half of his initial bet. The dealer then checks the card he dealt to himself face down. If the dealer has a blackjack, the players who took "insurance" are paid on a 2 to 1 basis for the insurance wager only. Thereafter, the players who do not also have blackjack lose their initial wager.

Another well known rule is that a player is allowed to double his initial bet and receive one and only one additional card. This is called "doubling down." The player wins if the value of his resultant three card hand is higher than the value of the dealer's hand (and the player has not busted).

Finally, a player is allowed to "split pairs." That is, if the first two cards dealt to the player are of the same value, the player may elect to "split" the two cards into separate hands. If the player chooses to "split," he has to apply his initial wager to one of the hands and has to place another wager, of the same amount, to the other hand. The player then plays each of the hands separately.

There are numerous variations to the method of playing Blackjack described above. For example, in some gaming establishments, the players' cards are dealt face down. Further, different rules may apply to "doubling down," "splitting pairs," and "insurance."

One disadvantage with known Blackjack type wagering games is that once a player "busts" (has a hand with a value of over 21), he has to wait until the entire round is over before being permitted to once again participate in the game. Since up to seven players may sit at a typical blackjack table, the player may have to wait a considerable amount of time before a new round begins. This can be quite frustrating for the player.

Furthermore, it is well known that the odds of winning are stacked in favor of the dealer and, therefore, the gaming establishment. However, existing Blackjack type games do not allow the players to place wagers on the possibility of the dealer's hand winning.

SUMMARY OF THE INVENTION

It is an object of the invention to provide a method of playing blackjack wherein each player is permitted to wager on the possibility of his hand or the dealer's hand winning.

In accordance with the illustrative embodiments, demonstrating features and advantages of the present invention, there is provided a modified method of playing a Blackjack-type wagering game on top of a table layout having a dealer location with a card area associated therewith and at least one player location with a first betting area, a second betting areas, and a card area associated therewith. The method includes allowing a player to elect whether to bet on the player obtaining a winning hand or the dealer obtaining a winning hand. The player places a wager on the first betting area if the player elects to bet on the dealer obtaining a winning hand. The player places a wager on the second betting area if the player elects to bet on the player obtaining a winning hand. The player and dealer are each dealt two cards on top of their corresponding card areas. If the player elects to bet on the player obtaining a winning hand, a round of Blackjack is played according to conventional rules.

If, on the other hand, the player elects to bet on the dealer obtaining a winning hand, the round of Blackjack is played in the following manner. Additional cards are dealt to the player on top of the player card area until the player obtains a hand having a value of 17 or more. The player wins on the wager if the value of the player's hand goes over 21. If the player's hand is less than 21, additional cards are dealt to the dealer on top of the dealer card area until the dealer obtains a hand having a value of 17 or more. The dealer's hand is compared to the player's hand and the player will be deemed the winner if the value of the dealer's hand is not over 21 but is higher than the value of the player's hand.

BRIEF DESCRIPTION OF THE DRAWING

For the purpose of illustrating the invention, there is shown in the drawing one form which is presently preferred, it being understood that the invention is not intended to be limited to the precise arrangements and instrumentalities shown.

The sole FIGURE is a schematic view of the table layout utilized in playing the modified Blackjack game of the present invention.

DETAILED DESCRIPTION OF THE PREFERRED EMBODIMENT

The present invention comprises a modified method for playing a Blackjack-type wagering game which utilizes at least one standard deck of 52 playing cards. While the present Blackjack-type wagering game will be described for use at a gaming table with one or more players, it should be noted that the game can be adapted to be played on a video gaming machine.

Referring to the FIGURE, a table layout 10, upon which the modified Blackjack game of the present invention is played, is schematically shown. The layout is preferably mounted on top of a conventional type gaming table (not shown). A plurality of playing locations 12 are provided along the periphery of the table. Typically, there are seven playing locations. Each of the playing locations has the following designated areas associated therewith: two betting areas 16 and 18, a commission area 20, and a card area 22. A dealer's location 24 is provided and has a chip rack 26 and a card area 28 associated therewith.

A round of the modified Blackjack game of the present invention is started by each player first deciding on whether to bet on his hand or the dealer's hand to win. If the player elects to bet on his hand, he places a wager or ante on the betting area 18. If, on the other hand, the player elects to bet on the dealer's hand to win, he places a wager or ante on the betting area 16. A commission must also be placed on the commission area 20 if the player elects to bet on the dealer's hand to win. The commission is preferably equivalent to 10% of the ante. However, each gaming establishment can set its own commission rate. In the preferred method, the value of any wagers placed on the betting area 16 (i.e., placed on the dealer's hand to win) must be in increments of $10.

Once all of the players have made their election and placed their bets, the commissions of the players who bet on the dealer to win are "locked up" or collected by the dealer. Thereafter, two cards are dealt onto each of the player's card areas 22 and onto the dealer's card area 28. The round then proceeds in a manner known in the art and as described above with the following modification. The players who have bet on the dealer's hand to win will not have a choice to "hit" or "stand." Instead, the hands of these players will be played according to the same rules which apply to the dealer. That is, they will have to "hit" if the value of their hand is less than 17 and will have to "stand" if the value of their hand is 17 or over.

The wagers of each of the players who bet on the dealer to win will remain on each of the corresponding betting areas 16, with the following two exceptions: (1) if such a player busts, the player will be paid and his cards will be discarded if the dealer does not have a possible Blackjack, or, if the dealer has a possible Blackjack, the player's cards will be folded but left in place until after the dealer's hand is exposed, and (2) if the player gets a Blackjack and the dealer does not show an Ace or 10 (possible Blackjack), the player's wager will be collected and his cards will be discarded.

After the dealer's hand is played out, the dealer will separately compare his hand with each of the player's. Each player will lose his wager if one of the following two scenarios has occurred: (1) if the dealer has the higher of the two hands and the player bet on himself to win, or (2) if the dealer has the lower of the two hands and the player bet on the dealer to win. Each player will be paid, typically on a 1 to 1 ratio, if the following occurred: (1) the dealer has the higher of the two hands and the player bet on the dealer to win, or (2) the dealer has the lower of the two hands and the player bet on himself to win. It should be noted that if the player bet on the dealer to win and the dealer gets a Blackjack, the player will be paid on a 3 to 2 ratio. The dealer will preferably pay and take the wagers in a counter clockwise order.

In an alternate method, each player who elects to bet on the dealer's hand to win will have the option of either placing a commission on the area 20 or telling the dealer to place a "17" button (not shown) on the commission area. If the player chooses to place the "17" button on the commission area 20, the wager he places on the betting area 16 does not have to be in a $10 increment. A player electing to play "Option-17," will automatically lose his wager if his hand has a value of 17. Additionally, if such a player gets a Blackjack he will be paid on a 1 to 1 ratio.

The present invention may be embodied in other specific forms without departing from the spirit or essential attributes thereof and accordingly reference should be made to the appended claims rather than to the foregoing specification as indicating the scope of the invention.

What is claimed is:

1. A modified method of playing Blackjack on top of a table layout having a dealer location with a card area associated therewith and at least one player location with a first betting area, a second betting area, and a card area associated therewith, said method comprising the steps of:

(a) allowing a player to elect whether to bet on the player obtaining a winning hand or a dealer obtaining a winning hand;

(b) the player placing a wager on the first betting area if the player elects to bet on the dealer obtaining a winning hand;

(c) the player placing a wager on the second betting area if the player elects to bet on the player obtaining a winning hand;

(d) dealing two cards to the player and to the dealer on top of the corresponding card areas;

(e) dealing additional cards to the player on top of the player card area until the player obtains a hand having a value of 17 or more if the player placed a wager on the first betting area, the player winning on the wager if the value of the player's hand is over 21;

(f) dealing additional cards to the dealer on top of the dealer card area until the dealer obtains a hand having a value of 17 or more;

(g) comparing the dealer's hand to the player's hand, the player winning on the wager if the value of the dealer's hand is not over 21 but is higher than the value of the player's hand and if the player placed a wager on the first betting area, and (h) allowing the player to play a round of Blackjack against the dealer according to conventional rules if the player placed a wager on the second betting area, the player winning on the wager if the player's hand has a higher value than the dealer's hand but is not over 21.

2. The method of claim 1 further including the step of requiring the player to pay a commission based on a percentage of the wager if the player elects to place a wager on the first betting area.

3. The method of claim 2 wherein the commission has a value of 10% of the wager.

4. The method of claim 1 wherein the player loses if the hand obtained by the player has a value of 17 and the player placed a wager on the first betting area.

5. The method of claim 4 wherein the player who places a bet on the first betting area wins on the wager in a ratio of 1 to 1 if the player is dealt a blackjack.

6. The method of claim 1 wherein the player wins on the wager in a ratio of 3 to 2 if the dealer is dealt a blackjack and if the player placed a wager on the first betting area.

* * * * *